US010343869B2

(12) United States Patent
Vergentini et al.

(10) Patent No.: US 10,343,869 B2
(45) Date of Patent: Jul. 9, 2019

(54) MACHINE FOR THE PRODUCTION OF SPOOLS WITH A SYSTEM FOR ALIGNMENT OF THE LONGITUDINAL CUTTING BLADES AND THE PATH OF THE LONGITUDINAL STRIPS GENERATED BY CUTTING WITH THE BLADES, AND RELEVANT METHOD

(71) Applicant: A.CELLI NONWOVENS S.P.A., Porcari (LU) (IT)

(72) Inventors: Francesco Vergentini, Pieve a Nievole (IT); Andrea Menconi, Viareggio (IT)

(73) Assignee: A.CELLI NONWOVENS S.P.A., Porcari (LU) (IT)

( * ) Notice: Subject to any disclaimer, the term of this patent is extended or adjusted under 35 U.S.C. 154(b) by 234 days.

(21) Appl. No.: 15/591,319

(22) Filed: May 10, 2017

(65) Prior Publication Data

US 2017/0327339 A1 Nov. 16, 2017

(30) Foreign Application Priority Data

May 11, 2016 (IT) ..... 102016000048314

(51) Int. Cl.

| | |
|---|---|
| ***B65H 18/10*** | (2006.01) |
| ***B65H 35/02*** | (2006.01) |
| ***B65H 23/032*** | (2006.01) |

(52) U.S. Cl.

CPC ..... *B65H 35/02* (2013.01); *B65H 18/103* (2013.01); *B65H 23/032* (2013.01); *B65H 2301/4148* (2013.01); *B65H 2301/413243* (2013.01); *B65H 2301/414321* (2013.01); *B65H 2404/1523* (2013.01); *B65H 2511/12* (2013.01); *B65H 2553/00* (2013.01); *B65H 2701/1924* (2013.01); *B65H 2801/84* (2013.01)

(58) Field of Classification Search

CPC .... B65H 35/02; B65H 18/103; B65H 23/032; B65H 2511/12; B65H 2301/4148; B65H 2301/414321; B65H 2301/413243; B65H 2553/00; B65H 2404/1523

USPC ..... 242/471

See application file for complete search history.

(56) References Cited

U.S. PATENT DOCUMENTS

| | | | |
|---|---|---|---|
| 4,621,777 | A | 11/1986 | O'Connor |
| 2013/0284847 | A1 | 10/2013 | Hou |

FOREIGN PATENT DOCUMENTS

| | | | |
|---|---|---|---|
| JP | 2002 226102 | A | 8/2002 |

*Primary Examiner* — William E Dondero

(74) *Attorney, Agent, or Firm* — McGlew and Tuttle, P.C.

(57) ABSTRACT

The machine (1) comprises: an unwinding section (3) of parent reels (Ba, Bb) of web material (Na, Nb); a cutting station (13), comprising a plurality of cutting members (201, 203) to divide the web material (Na, Nb) into longitudinal strips (S); a plurality of winding stations (15); in each winding station (15), a guide arm (31) to guide the longitudinal strip (S), adjustable parallel to the rotation axis (C-C) of the winding mandrel (51). The cutting station (13) comprises sensor members (213, 214) to detect the position of the cutting members (201, 203). A control unit (216) is interfaced with the sensor members (213, 214) of the cutting station (13) and the positioning actuators (27), to position the guide arms (31) parallel to the rotation axis (C-C) of the respective winding mandrel (51) as a function of the position of the corresponding cutting member (201, 203).

7 Claims, 8 Drawing Sheets

15

61
61
23
19
101
93
63
29
35
37
23
39
31
25
31A
B
17
39A
A-A
41
45
55
41B
21
45
49

MACHINE FOR THE PRODUCTION OF SPOOLS WITH A SYSTEM FOR ALIGNMENT OF THE LONGITUDINAL CUTTING BLADES AND THE PATH OF THE LONGITUDINAL STRIPS GENERATED BY CUTTING WITH THE BLADES, AND RELEVANT METHOD

TECHNICAL FIELD

The invention relates to machines for the production of spools formed from strips of helically wound web material, for example for the production of spools formed from strips of non-woven fabric.

Embodiments described herein relate in particular to improvements in the guide systems for the longitudinal strips along the path from a longitudinal cutting station to a plurality of sequentially arranged winding stations.

BACKGROUND ART

In many industrial sectors it is necessary to transform reels of web material of one size into spools of a different size, by means of a process of unwinding parent reels, or so-called jumbo reels, and rewinding them into spools with different size characteristics. In certain cases the web material from a single parent reel is unwound and divided into longitudinal strips, each of which is wound onto a helically wound spool. The finished spools obtained in this way are used as semi-finished products to feed production lines for other articles.

Machines that produce spools of helically wound web material from parent reels are sometimes called spooling machines. The web material can be a non-woven fabric, for example. The helically wound spools thus obtained are used to feed machines for the production of sanitary towels, diapers and other hygienic and sanitary articles, for example. The web material wound on the parent reels sometimes has a transversal size (corresponding to the axial dimension of the parent reel) that is 5-15 times the width of the individual longitudinal strips that are obtained by longitudinal cutting of the web material from the parent reels. The individual strips are fed simultaneously to helical winding stations, in each of which a helically wound spool is formed. The winding stations are arranged in line one after the other in a machine direction, defined by the direction of advance of the longitudinal strips obtained by cutting the material from the parent reels. Each strip is fed to the respective winding station along a feed path.

The path that each longitudinal strip follows from the cutting station to the respective winding station may be very long, even several meters in length. For proper guidance of the longitudinal strips of web material, a guide member, typically an arm supporting a guide roller, is provided in each winding station. This is positioned by the operator in such a way as to be approximately aligned with the blade in the cutting station that generates the respective longitudinal strip.

Due to the considerable length of the feed path for each longitudinal strip, this alignment is a long and complex operation, which requires the intervention of experienced personnel.

There is thus a need to improve the spooling machines of the type described above to obtain easier and more precise alignment of the web material longitudinal strip guide systems.

SUMMARY

According to one embodiment, to partly or fully solve one or more of the problems found with machines according to the prior art, a machine for forming helically wound spools is provided, comprising: an unwinding section of parent reels of web material; a cutting station, comprising a plurality of cutting members to divide the web material coming from the unwinding section into longitudinal strips, wherein the cutting members are positionable in a direction transverse to a feed direction of the web material; a plurality of winding stations, each of which is provided with a winding mandrel having a rotation motion around a rotation axis and a reciprocating translation motion in a direction parallel to the rotation axis, to helically wind one of said longitudinal strips around the winding mandrel. Furthermore, each winding station is provided with a guide arm to guide the longitudinal strip, adjustable parallel to the rotation axis of the winding mandrel. The machine also comprises, for each longitudinal strip, a feed path from the cutting station to the respective guide roller. Advantageously, the cutting station comprises sensor members to detect the position of the cutting members along the transverse direction. A control unit is interfaced with the sensor members of the cutting station and with positioning actuators, to position the guide arms in the various winding stations in a direction parallel to the rotation axis of the respective winding mandrel according to the position of the corresponding cutting member.

On each guide arm a guide roller may be mounted, around which the respective longitudinal strips is guided.

The cutting members, for example circular blades and respective counter-blades, can be positioned manually in the required transversal position, which is determined by the dimensions and number of longitudinal strips into which the web material is to be divided. In other embodiments, the machine may also comprise actuators for positioning the cutting members. The actuators for positioning the cutting members may also be interfaced with the control unit. In this way an operator can position both the cutting members and the guide members simply using a suitable interface on the control unit, for example a touch screen, a keyboard or another device.

According to a further aspect, a method is provided for producing longitudinal strips from a web material and helically winding the longitudinal strips onto helically wound spools. As described herein, the method comprises the following steps:

- positioning a plurality of cutting members;
- detecting the position of the cutting members through sensor members and acquiring the detected position through a control unit;
- through respective positioning actuators controlled by said control unit according to the position of the cutting members, positioning a corresponding plurality of guide arms, each placed in a respective winding station, in which a winding mandrel provided with a rotation motion about a rotation axis and with a reciprocating translation motion in a direction parallel to the rotation axis is arranged;
- feeding a web material from a parent reel toward the cutting members;
- dividing the web material into a plurality of longitudinal strips through the cutting members;
- feeding each longitudinal strip of web material to a respective one of said winding stations;

guiding each longitudinal strip through the guide arm toward the respective winding mandrel and helically winding the longitudinal strip around the winding mandrel.

Further advantageous features and embodiments of the machine and method according to the invention are illustrated in the description that follows and in the attached claims, which form an integral part of this description.

BRIEF DESCRIPTION OF THE DRAWINGS

This invention will be better understood by following the description and the enclosed drawing, which shows a practical and non-limiting embodiment of the invention. More specifically, in the drawing.

DETAILED DESCRIPTION OF EMBODIMENTS

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
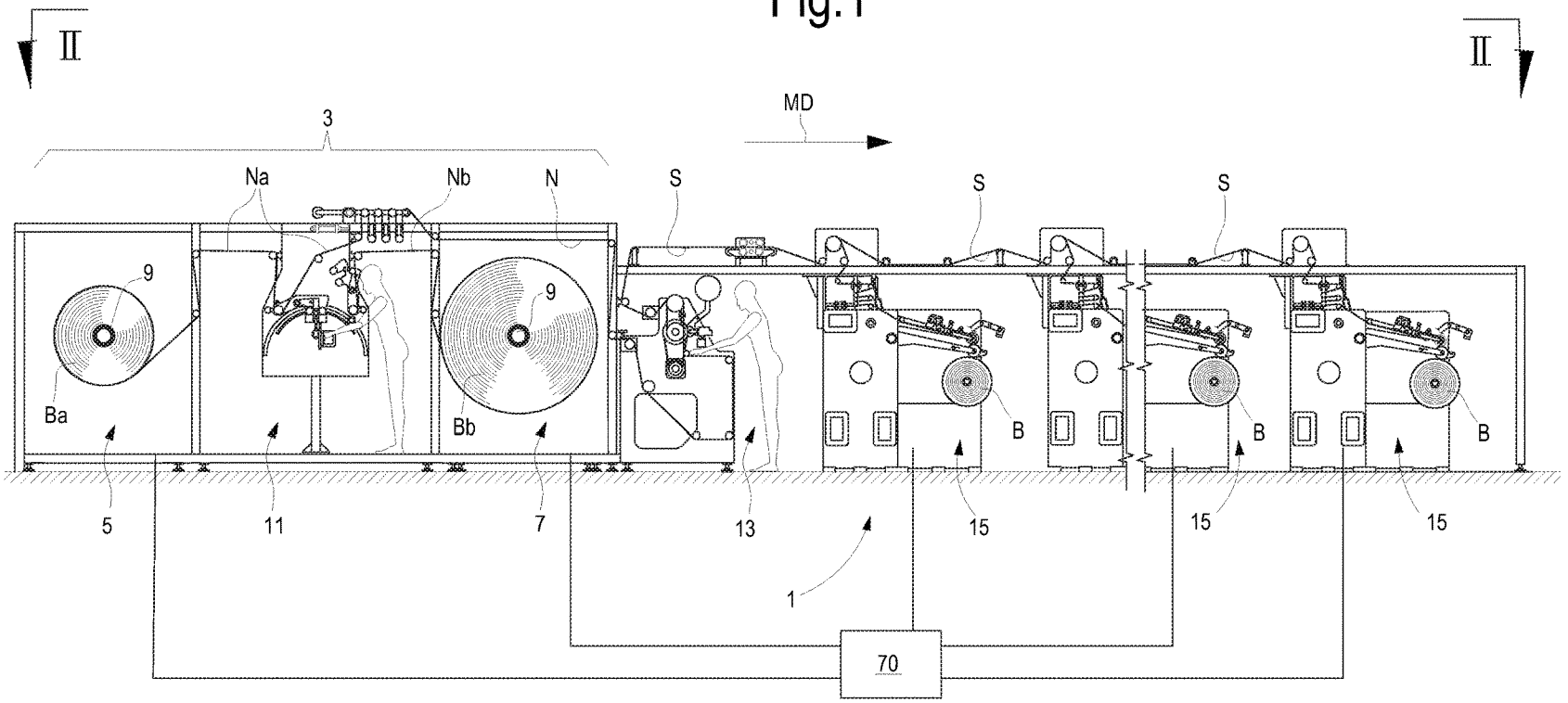
FIG. 1 shows a side view of the machine with its main stations.

FIG. 1 shows an overall side view of the machine for the production of helically wound spools. The machine is in reality a converting line inclusive of a plurality of stations. The machine is indicated as a whole by 1. It has an unwinding section 3, in which parent reels, also known as master rolls or jumbo rolls, are positioned, indicated with Ba and Bb in FIG. 1. In the embodiment illustrated, the unwinding section 3 comprises a first unwinding station 5 and a second unwinding station 7. The two unwinding stations 5 and 7 may be substantially symmetrical, and each have an unwinding mandrel, indicated with 9, on which the parent reels Ba, Bb are mounted. These latter contain a certain amount of web material, indicated with Na and Nb for the reels Ba and Bb of FIG. 1.

Between the two unwinding stations 5, 7 a cutting and welding station 11 may be arranged, wherein the tail of a web material from an exhausted parent reel positioned in one of the unwinding stations 5, 7 is welded to the leading edge of a web material on a parent reel standing-by in the other of the two unwinding stations 5, 7, to allow continuous working using a number of parent reels in sequence. The welding of web materials coming from successive parent reels takes place after slowing down or temporary stopping the unwinding of the reel that is finishing, as the machine described is of the start-stop type. In other embodiments the welding station may be located downstream of the two unwinding stations 5, 7. In yet other embodiments, more than two unwinding stations may be provided.

Figure 2:
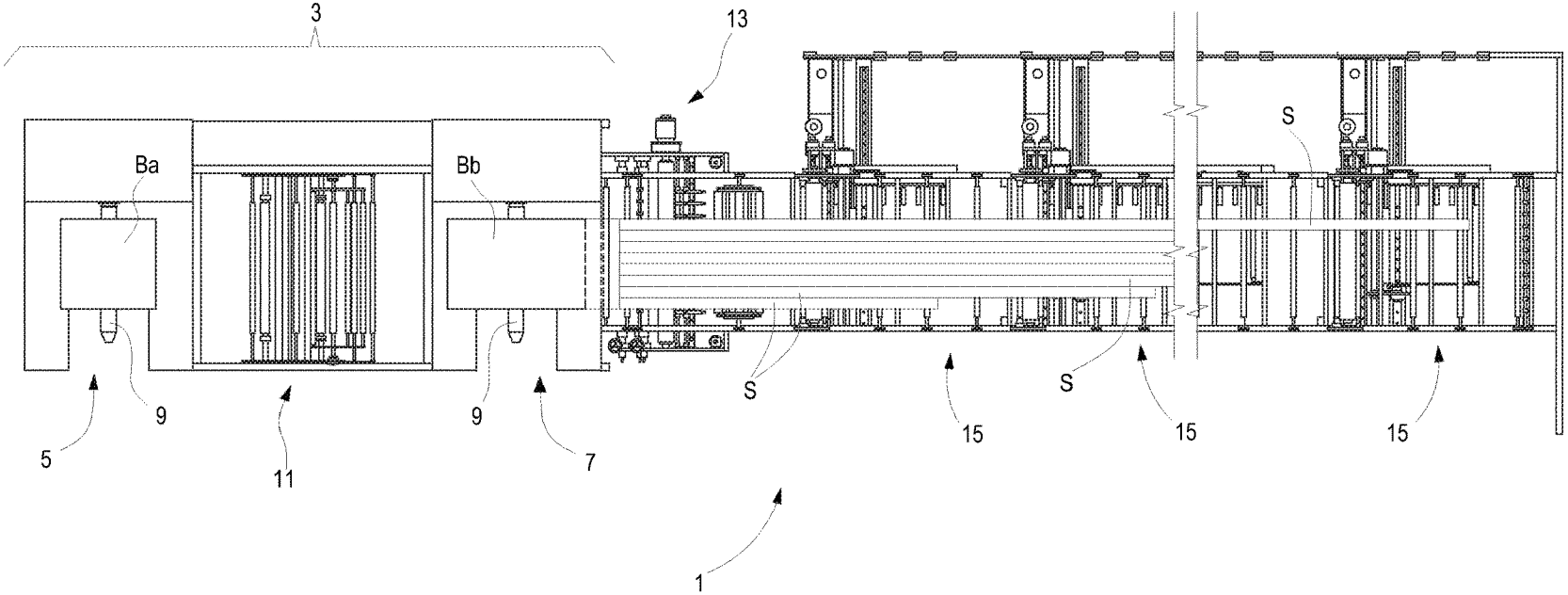
FIG. 2 shows a plan view along II-II of FIG. 1.

Downstream of the unwinding section 3 a cutting station 13 is provided, in which the web material fed by the unwinding section, generically indicated with N, is cut longitudinally and divided into a plurality of longitudinal strips S, which are fed to a plurality of helical winding stations, which can be the same as each other, each one indicated with 15. The helical winding stations 15 are arranged in sequence according to the machine direction, generically indicated by the arrow MD and represented by the direction in which the longitudinal strips S advance. For the purpose of illustration, FIGS. 1 and 2 are partial representations of just three winding stations 15, but it must be understood that the number of winding stations may vary from two to ten or more, if necessary, according to the number of longitudinal strips S into which a web material N can be divided.

Each strip S into which the web material N coming from the unwinding section 3 is divided advances along a path from the cutting station 13 to the respective winding station 15. In advantageous embodiments the feed path is located over the winding stations, but the option of arranging the feed paths under the winding stations must not be excluded.

The length of the path of each longitudinal strip S is different from the length of the paths of the remaining longitudinal strips, and depends on the position of the respective winding station 15, to which the longitudinal strip is fed.

Generically indicated with 70 is a control unit, for example a microprocessor, a micro-computer or a PLC, to control one or more of the stations making up the machine 1. In some embodiments the machine 1 may be provided with a plurality of PLCs or other dedicated local control units, for example, to supervise the operation of a part, section or station in the machine 1. The central unit 70 may be assigned to supervise and co-ordinate various local control units or local PLCs. In other embodiments a single control unit may be provided to manage the whole line or machine 1, or a plurality of the stations thereof.

Figure 3:
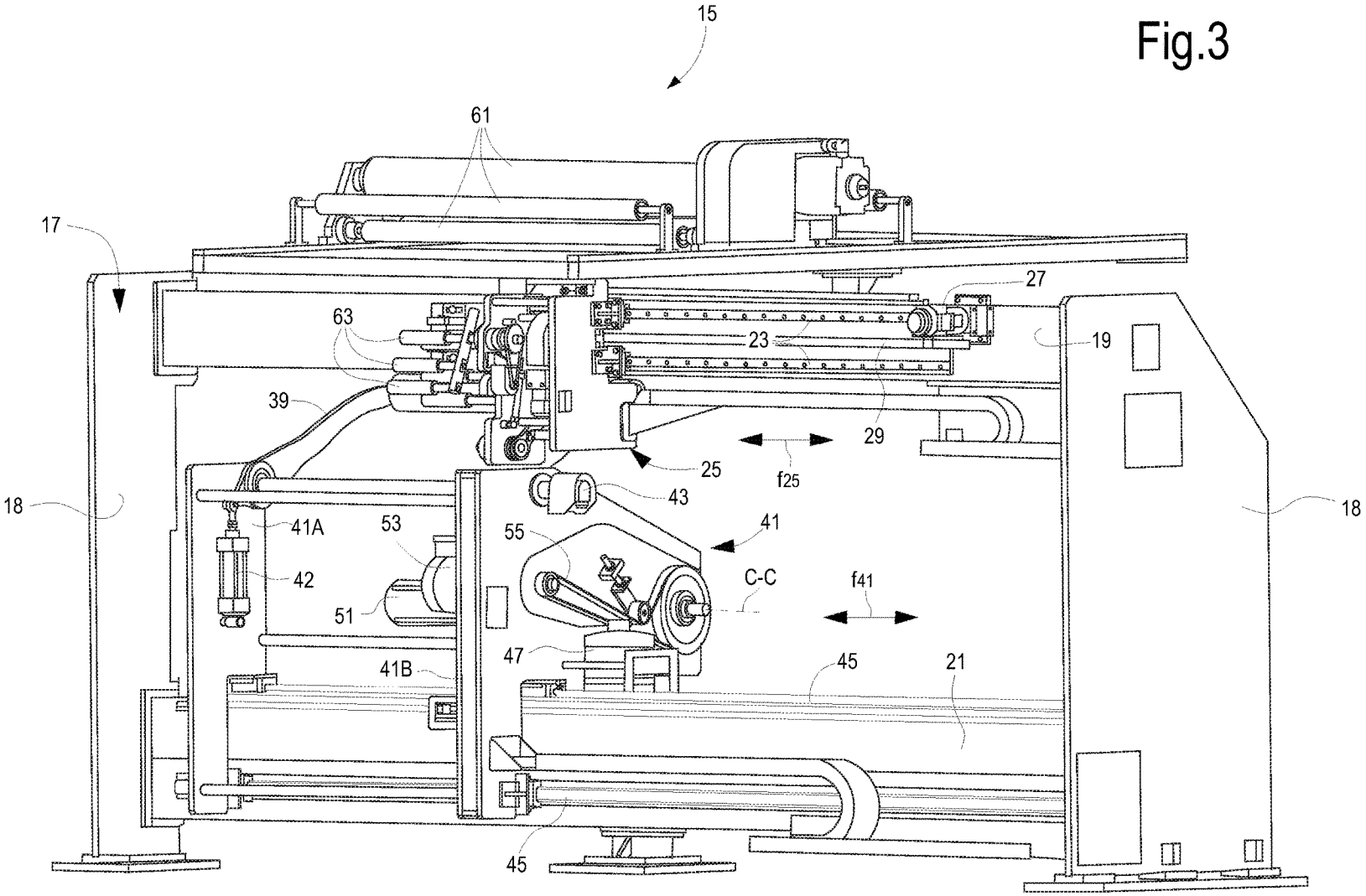
FIGS. 3 and 4 show axonometric views of a helical winding station.
Figure 4:
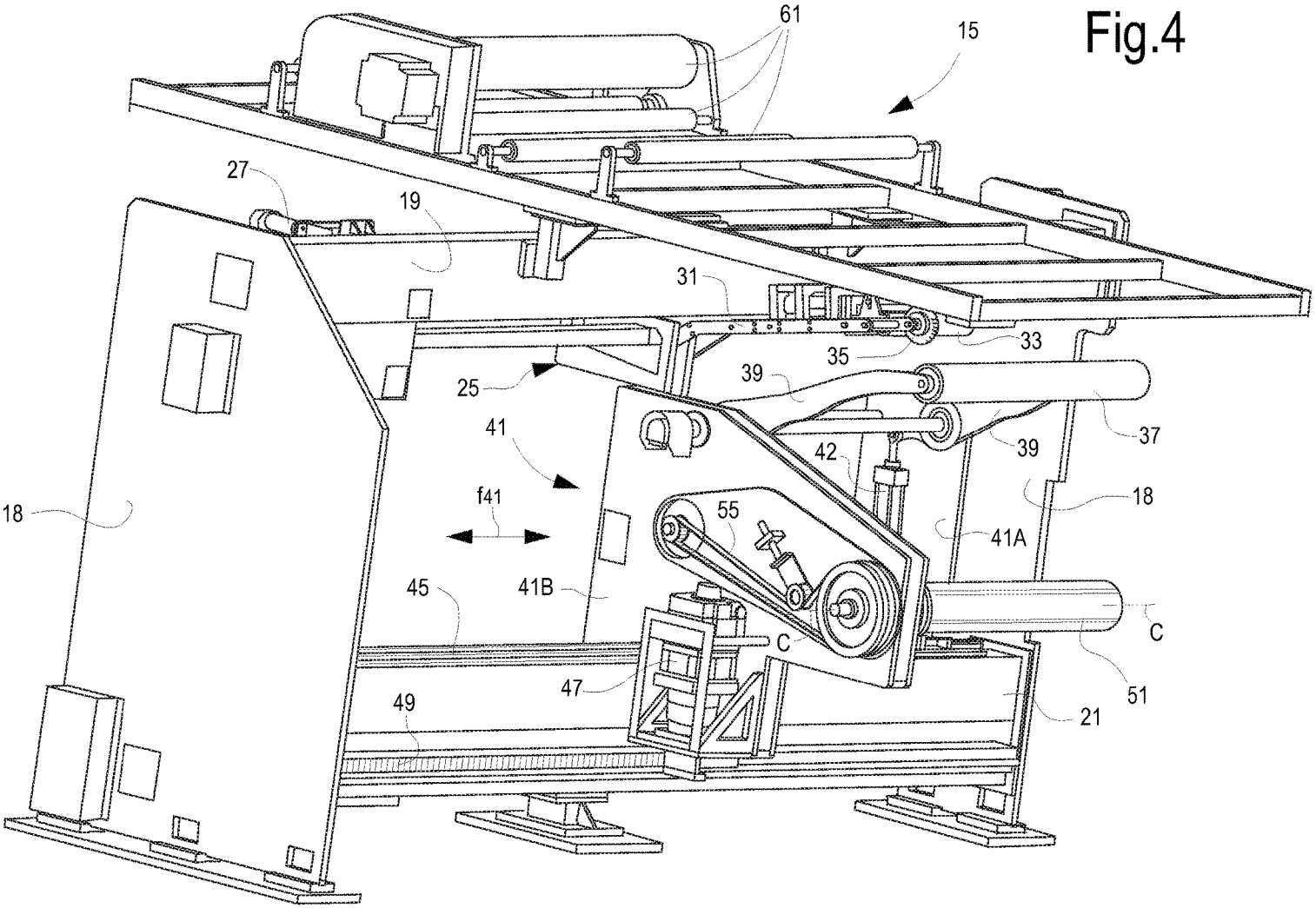
Figure 5:
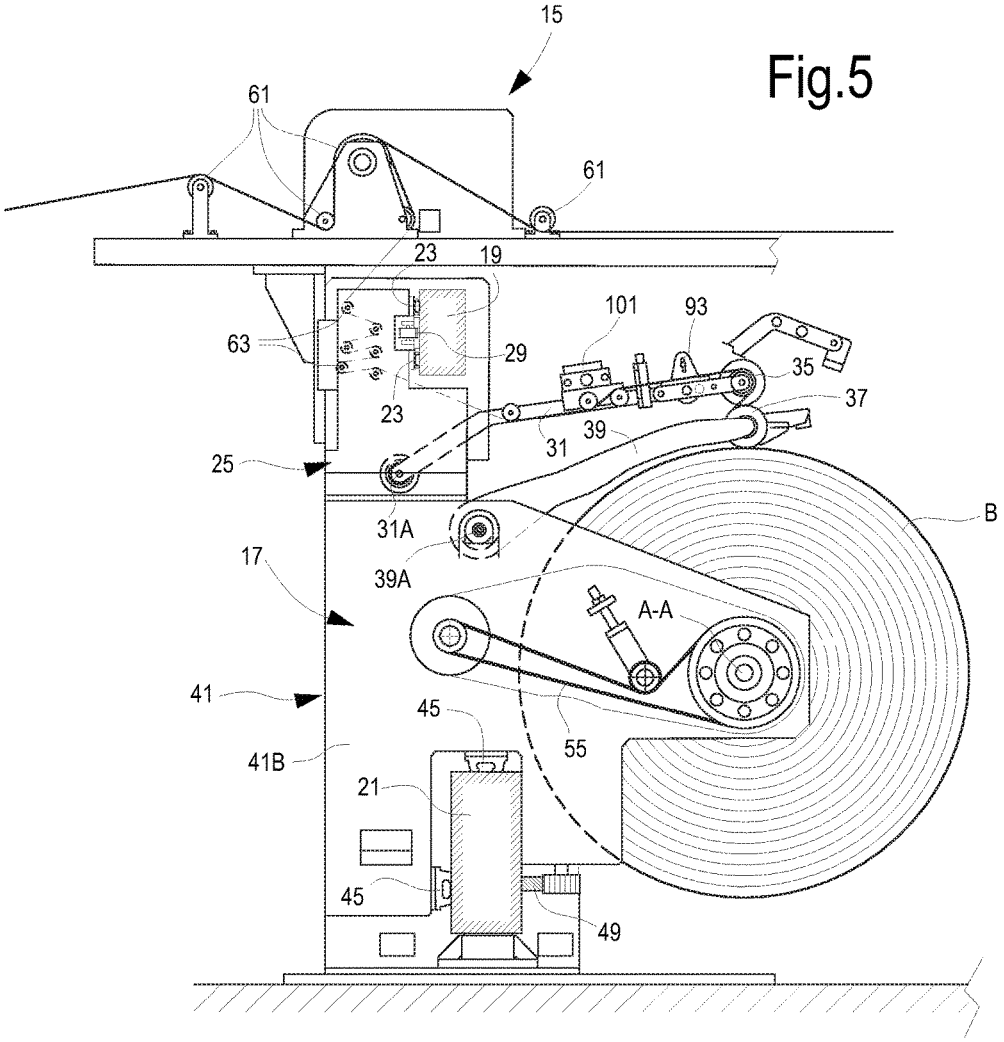
FIG. 5 shows an enlarged side view of a helical winding station.
Figure 6:
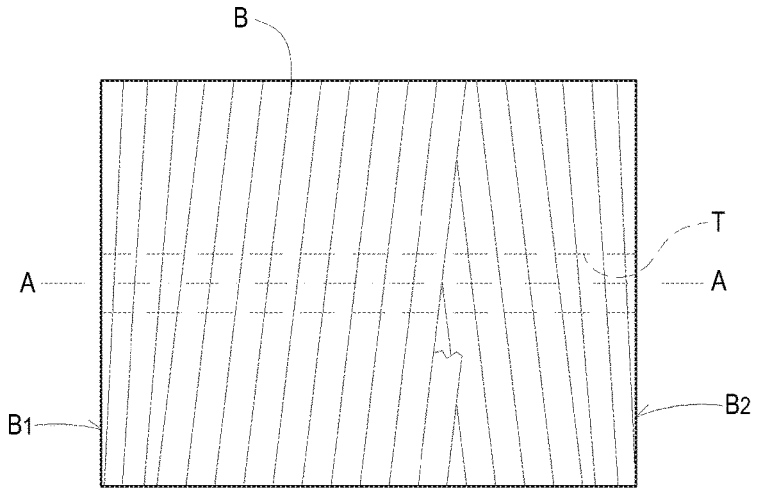
FIG. 6 shows a diagram of a helically wound spool obtained using a helical winding station according to FIGS. 3 to 5.

FIGS. 3-5 show in greater detail a possible configuration of a helical winding station 15, while FIG. 6 shows a diagram view of a helically wound spool obtained using a winding station 15. As shown in FIG. 6, the strip S that forms the helically wound spool B forms helical turns around a tubular winding core T. A-A indicates the winding axis of the helically wound spool B, and B1, B2 indicate the two axial ends of the helically wound spool B.

The general structure of the helical winding station 15 is clearly shown in FIGS. 3 to 5. It comprises a bearing structure 17, which may comprise a pair of side walls 18, an upper crossbeam 19 and a lower crossbeam 21 joining the two side walls 18. On the upper crossbeam 19 first guides 23 can be provided, along which a slide 25 can move in a direction f25. Reference 27 indicates a motor that, by means of a belt 29, a threaded bar or other suitable transmission member, controls the movement of the slide 25 along the guides 23. In other embodiments, the movement may be controlled by an electric motor mounted on the slide 25, which rotates a pinion meshing with a rack constrained to the crossbeam 21.

The slide 25 carries a pivoting guide arm 31, pivoted at 31A to the slide 25 and which has the function of guiding the longitudinal strip S fed to the helical winding station 15. The guide arm 31 can support at its distal end a guide roller 33, having an axial length sufficient to receive the longitudinal strip S having the maximum width allowed by the machine 1. The guide arm 31 may be lifted and lowered by pivoting around the axis 31A. In some embodiments the guide roller 33 may be interchangeable according to the transversal size of the longitudinal strip S, for instance.

A wheel or support roller 35 can be mounted coaxially to the guide roller 33, with which the guide arm 31 rests on a contact roller 37. The contact roller 37 may be idly mounted on arms 39 hinged around a pivoting axis 39A to a carriage 41. Reference number 42 indicates a cylinder-piston actuator that can control the lifting and lowering movement of the arms 39 around the pivoting axis 39A. The arms 39 can be associated with an encoder 43 that can detect the angular position of the arms 39 with respect to the carriage 41.

The carriage 41 may comprise two side walls 41A, 41B joined together by crossbeams, bars or beams. Carriage 41 may move with a reciprocating translation motion according to the double arrow f41 along guides 45 that can be constrained to the lower beam 21. The reciprocating translation motion of carriage 41 according to the double arrow f41 can be controlled by an electric motor 47. In the embodiment illustrated the electric motor 47 is mounted on the carriage 41 and comprises a pinion in mesh with a rack 49 constrained to the beam 21. In other embodiments, other drive mechanisms can be foreseen, for example using a fixed motor and a screw or threaded bar. By co-acting with a stationary rack 49, the motor 47 on board the carriage 41 allows high linear accelerations of the carriage 41 to be obtained.

A winding mandrel 51 can be mounted on the carriage 41, with a rotation axis substantially parallel to the axis of the contact roller 37 and to the pivoting axis 39A or the arms 39 that supports the contact roller 37, as well as to the reciprocating straight movement direction according to f41 of the carriage 41. The winding mandrel 51 can be driven into rotation by an electric motor 53 that can be carried by the carriage 41. For example, the winding mandrel 51 and the motor 53 can be carried by the side wall 41B of the carriage 41. A belt 55 can be provided to transmit the motion from the motor 53 to the winding mandrel 51. The rotation axis of the winding mandrel 51 is labeled C-C. This rotation axis coincides with the axis A-A of the spool B forming around the winding mandrel 51.

The structure described above allows the winding mandrel 51 to perform a double winding motion, and more specifically: a rotation movement around its own axis C-C, controlled by motor 53; and a reciprocating translation motion indicated by the double arrow f41 and controlled by motor 47. When a tubular winding core T is mounted on the winding mandrel 51, helical winding of the longitudinal strip S illustrated in FIG. 6 is achieved. During the helical winding movement the guide roller 33 may remain substantially stationary in the transversal direction, i.e. in direction f25, while it may rise gradually, together with the contact roller 37, as the diameter of the helically wound spool B increases in size. The encoder 43 may detect the angular position of the arms 39 and may therefore provide a measurement of the diameter of the helically wound spool B being formed on the winding mandrel 51.

Guide rollers for the longitudinal strips S above the winding stations 15 are indicated with 61. Tensioning rollers for the longitudinal strip S fed to each of the winding stations 15 are indicated with 63. The tensioning rollers 63 define a zig-zag path for the longitudinal strip S to form a sort of festoon. Some of the tensioning rollers 63 have a mobile axis to maintain the longitudinal strip S tensioned as required.

The machine 1 described so far operates as follows. At least one parent reel Ba or Bb is placed in at least one of the two unwinding stations 5, 7. The web material Na or Nb from the parent reel is unwound and fed through the cutting station 13, where the web material is cut into a plurality of longitudinal strips S. Each longitudinal strip S is fed to one of the helical winding stations 15 to form respective helically wound spools B. In order to be formed, each helically wound spool B usually requires the use of more than one parent reel Ba, Bb. Typically, between two and five parent reels Ba, Bb are necessary to form a series of helically wound spools B, but this number must not be considered to be limiting. As a result, when a parent reel unwinding in one of the unwinding stations 5, 7 finishes, its trailing edge is joined to the leading edge of a second parent reel that has been prepared and is waiting in the other of the two unwinding stations 5, 7. Welding takes place in the welding station 11. Welding usually takes place at low speed or with the machine stopped. Consequently, the machine 1 is slowed down or stopped when the parent reel being used has to be replaced. In other embodiments a supply of web material or longitudinal strips S can be provided, formed for example using a plurality of mobile guiding rollers. This supply may allow the winding stations 15 to continue working, if necessary at a reduced speed, even if the parent reels are stopped and no web material Na, Nb is being delivered by the unwinding station 3 for the time necessary to replace the parent reel.

When the helically wound spools B have been completed, they are removed from the winding mandrels 51 in the winding stations 15 and replaced by new tubular winding cores to start the next winding process.

The operation is usually carried out in such a way that all the helically wound spools B are completed at the same time, and can thus be replaced all together, stopping the machine 1 for the minimum amount of time possible. For that purpose the machine 1 is slowed down until it stops, that is to say until the feeding speed of the longitudinal strips S is reduced to zero.

Figure 7:
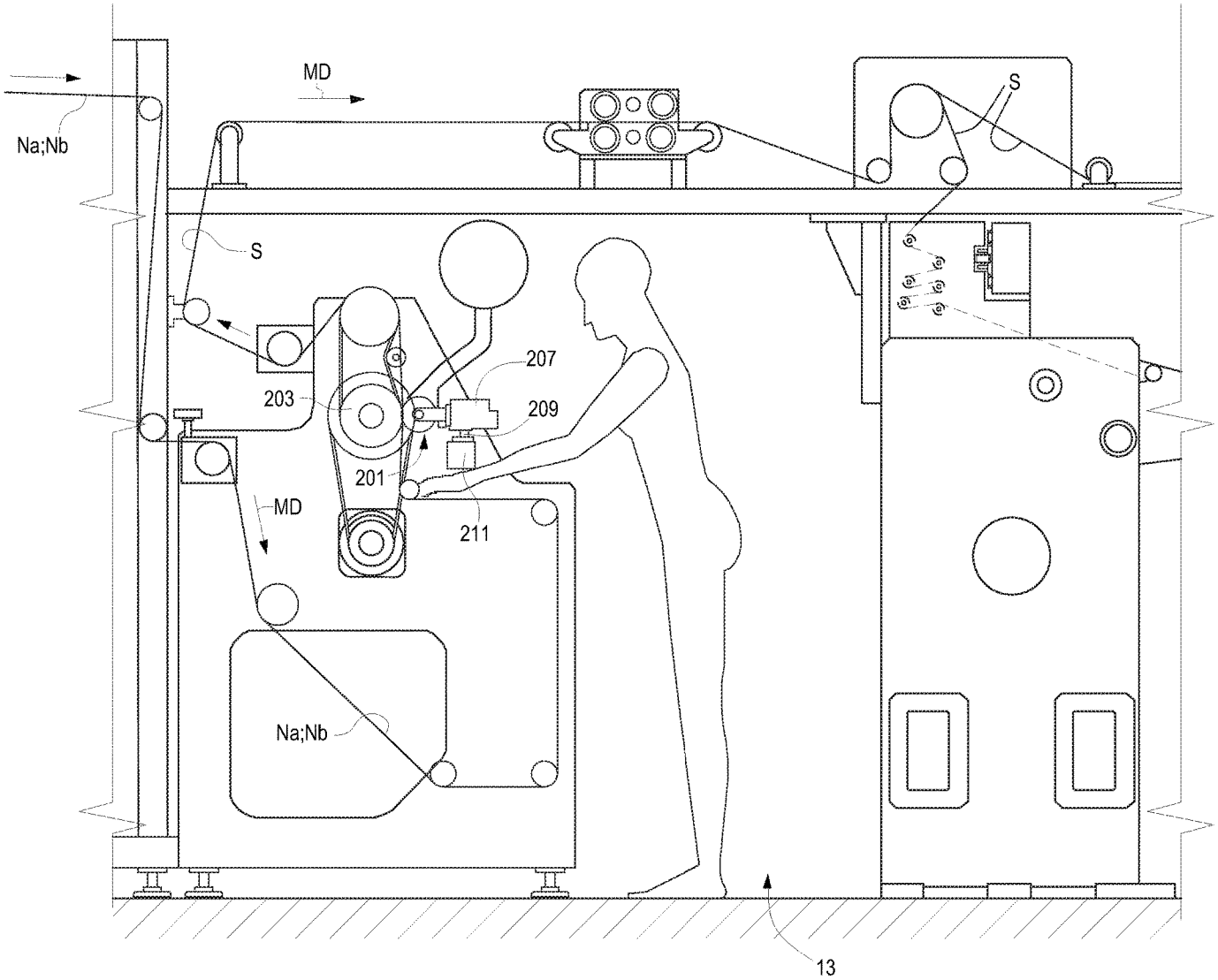
FIG. 7 shows an enlarged side view of a longitudinal cutting station.

FIG. 7 shows an enlarged view of the cutting station 13. Reference number 201 indicates blades in the form of circular cutting blades, aligned transversally, that is to say in a direction orthogonal to the direction (arrow MD) of advance of the web material Na, Nb to be cut. The circular blades 201 co-act with counter-blades 203, to cut the web material Na, Nb into longitudinal strips S.

Figure 8:
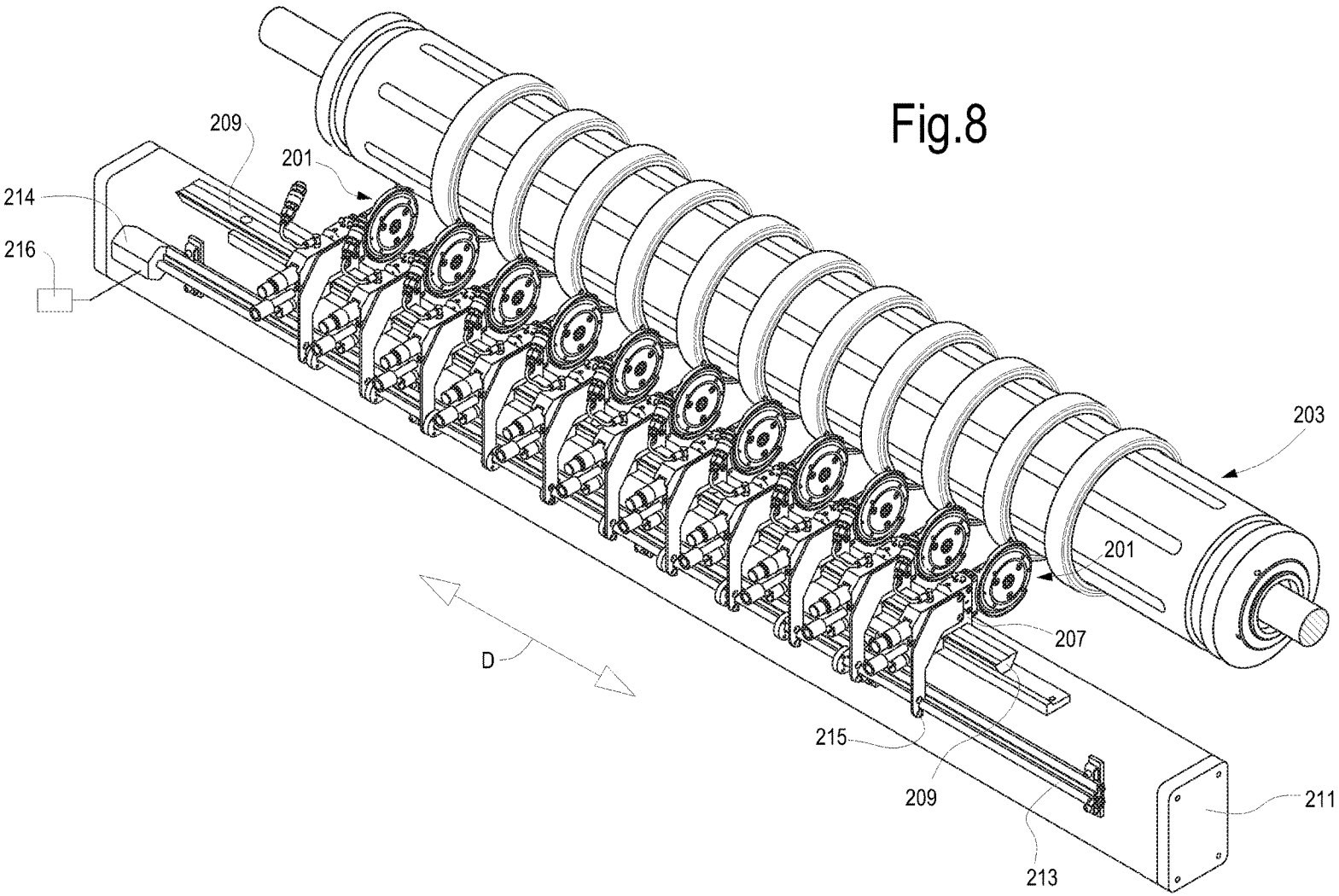
FIG. 8 shows an axonometric view of the web material longitudinal cutting members.

As more clearly shown in FIG. 8, in some embodiments each circular blade 201 is mounted on a slide 207, the position whereof is adjustable along a transversal guide 209 carried by a beam 211, for example. The adjustment allows each circular blade 201 to be brought into the position required according to the width of the respective longitudinal strip S that the circular blade 201 must generate.

The circular blades 201 can be driven by means of electric motors or other devices. In the embodiment illustrated the circular blades 201 are mounted in idle mode. They can be brought into rotation by friction with the counter-blades 203, which are driven, for example by a single motor that puts into rotation an expandable shaft, on which the counter-blades 203 can be mounted and adjusted in position. Blades 201 and counter-blades 203 can be configured to perform a scissor-type cut.

In other embodiments the cut can be a pressure cut. In this case the circular blades 201 can co-act with a single counter-blade, consisting of a roller with a smooth surface. In this way the width of the longitudinal strips S is set by adjusting the position of the blades only. Vice versa, if the cutting system envisages counter-blades 203, the position of these latter is also modified and adjusted according to the transversal size of the strips. The circular blades 201 can be mounted on the respective slides so as to be in an active position, in which they co-act with the respective counter-blades 203, or in an inactive position, in which they are radially distanced from the counter-blades 203. In this way, according to manufacturing requirements, it is possible to keep a variable number of from 1 to n circular blades in an active condition, where n is the maximum number of circular blades 201 available. In a corresponding manner, a variable number of from 2 to n+1 longitudinal strips S is produced, and a variable number of from 2 to n+1 helical winding stations 15 is kept in operation.

The circular blades 201 can be associated with sensor members to identify the position of each circular blade 201 along the transversal alignment direction, indicated by D in FIG. 8. For that purpose, it is possible to use, for example, magnetic sensors comprising a bar 213 integral with the cross beam 211 and interfaced with an electronic device 214, configured to detect the position along direction D of magnets 215 fixed to the slides 207 that carry the individual blades 201. Sensors of this type are known in the art.

The electronic device 214 is interfaced with a control unit 216, which processes the signals relating to the position of the circular blades 201. In particular, the control unit 216 can be interfaced with the motors 27 of the various winding stations 15, said motors representing positioning actuators for the guide arms 31 in the transversal direction, that is to say parallel to the axis of the respective winding mandrel in the winding station 15.

The circular blades 201 sub-divide the web material Na, Nb into individual longitudinal strips S, each of which is fed to one of the winding stations 15. By means of the control unit 216 it is possible to position the slide 25 precisely along the guides 23, checking the respective motors 27 based on the position signals for the circular blades 201, obtained from the sensor members 213. In this way, the guide arm 31 and consequently the guide roller 33 is correctly positioned, in line with the respective cutting member and therefore with the respective longitudinal strip S formed in the cutting station 13.

In the embodiment illustrated in FIGS. 7 and 8 the slides 207 carrying the circular blades 201 are positioned manually in the D direction. The positions are detected by means of sensor members 213 and communicated to the control unit 216. This controls the individual motors 27 in each winding station 15, so as to correctly position the slide 25 (and the relevant members on board it, in particular the guide arm 31 and the relevant guide roller 33) in a position aligned with a circular blade 201 which cuts the longitudinal strip S destined for the respective winding station 15.

In other embodiments it is also possible to provide an actuator to position the circular blades 201 in the required positions. In that case, the control unit 216 may also control an actuator or a plurality of actuators that perform positioning of the individual circular blades 201. The operator can thus manage positioning of the circular blades 201 and of the slides 27 according to the position in which the longitudinal strips S are formed and wound, acting directly by means of a suitable interface, for example a touch screen, a keyboard, a mouse, or the like.

The number and position of the active and inactive circular blades may be communicated to the control unit by the operator or may be detected automatically, by means of suitable sensors.

While the embodiment illustrated provides for detection of the transversal position of the circular blades 201, other embodiments may provide for detection of the transversal position of the counter-blades, or for detection of both the positions of the circular blades 201 and the counter-blades 203.

What is claimed is:

1. A machine for forming helically wound, comprising:

an unwinding section of parent reels of web material;

a cutting station, comprising a plurality of cutting members to divide the web material coming from the unwinding section into longitudinal strips, wherein the cutting members are positionable in a direction transverse to a feed direction of the web material;

a plurality of winding stations, in each of which a winding mandrel provided with a rotation motion about a rotation axis and a reciprocating translation motion in a direction parallel to the rotation axis is arranged, to helically wind one of said longitudinal strips around the winding mandrel;

in each winding station, a guide arm to guide the longitudinal strip, adjustable parallel to the rotation axis of the winding mandrel;

wherein the cutting station comprises sensor members to detect the position of the cutting members along the transverse direction; and wherein a control unit is interfaced with the sensor members of the cutting station and to positioning actuators, to position the guide arms parallel to the rotation axis of the respective winding mandrel as a function of the position of the corresponding cutting member.

2. Machine according to claim 1, wherein on each guide arm a guide roller is mounted, around which the respective longitudinal strip is guided.

3. Machine according to claim 2, wherein each cutting member comprises a blade and a counter-blade co-acting with each other, at least one of said blade and counter-blade being associated with said sensor members.

4. Machine according to claim 1, comprising actuators to position the cutting members, interfaced with the control unit.

5. Machine according to claim 1, comprising actuators to position the cutting members, interfaced with the control unit.

6. Machine according to claim 1, wherein each cutting member comprises a blade and a counter-blade co-acting with each other, at least one of said blade and counter-blade being associated with said sensor members.

7. A method for producing longitudinal strips from a parent reel of web material and helically winding the longitudinal strips on helically wound spools; the method comprising the steps of:

positioning a plurality of cutting members along a positioning direction transverse to a feeding direction of the web material;

detecting the position of the cutting members through sensor members and acquiring the detected position through a control unit;

through respective positioning actuators controlled according to the detected positions of the cutting members, positioning a corresponding plurality of guide arms, each placed in a respective winding station, in which a winding mandrel provided with a rotation motion about a rotation axis and with a reciprocating translation motion in a direction parallel to the rotation axis is arranged;

feeding a web material from a parent reel spool toward the cutting members;

through the cutting members dividing the web material into a plurality of longitudinal strips;

feeding each longitudinal strip to a respective one of said winding stations;

guiding each longitudinal strip through a guide arm toward the respective winding mandrel and helically winding the longitudinal strip on the winding mandrel.

* * * * *